US008905535B2

(12) United States Patent
Zheng et al.

(10) Patent No.: US 8,905,535 B2
(45) Date of Patent: Dec. 9, 2014

(54) DOT-MATRIX PRINTER

(75) Inventors: Lei Zheng, Shandong (CN); Jigang Zhang, Shandong (CN); Qiangzi Cong, Shandong (CN); Tianxin Jiang, Shandong (CN); Min Yang, Shandong (CN)

(73) Assignee: Shandong New Beiyang Information Technology Co., Ltd. (CN)

( * ) Notice: Subject to any disclaimer, the term of this patent is extended or adjusted under 35 U.S.C. 154(b) by 455 days.

(21) Appl. No.: 13/123,109

(22) PCT Filed: Jan. 22, 2009

(86) PCT No.: PCT/CN2009/070271

§ 371 (c)(1),
(2), (4) Date: Apr. 7, 2011

(87) PCT Pub. No.: WO2010/040284

PCT Pub. Date: Apr. 15, 2010

(65) Prior Publication Data

US 2011/0234732 A1 Sep. 29, 2011

(30) Foreign Application Priority Data

Oct. 10, 2008 (CN) ..... 2008 1 0167483

(51) Int. Cl.
*B41J 2/01* (2006.01)
*B41J 15/04* (2006.01)

(52) U.S. Cl.
CPC ..... *B41J 15/042* (2013.01)
USPC ..... 347/104; 347/5; 347/8; 347/16; 347/88; 347/99; 347/100; 347/101; 347/102; 347/103

(58) Field of Classification Search
USPC ..... 347/5, 8, 16, 88, 99–104
See application file for complete search history.

(56) References Cited

U.S. PATENT DOCUMENTS

| | | | | |
|---|---|---|---|---|
| 4,909,645 | A * | 3/1990 | Sudo et al. | 400/120.16 |
| 5,507,482 | A * | 4/1996 | Tenpaku et al. | 271/251 |
| 6,964,475 | B2 * | 11/2005 | Nebashi et al. | 347/101 |
| 7,118,208 | B2 * | 10/2006 | Nebashi et al. | 347/101 |
| 7,722,269 | B2 * | 5/2010 | Kitabatake | 400/323 |
| 8,152,393 | B2 * | 4/2012 | Tsuchiya et al. | 400/621 |
| 8,240,842 | B2 * | 8/2012 | Ito et al. | 347/104 |
| 2004/0100549 | A1 | 5/2004 | Nebashi et al. | |
| 2005/0232679 | A1 | 10/2005 | Na et al. | |
| 2007/0154238 | A1 * | 7/2007 | Yokoi | 399/124 |

FOREIGN PATENT DOCUMENTS

| | | | |
|---|---|---|---|
| CN | 1264693 | C | 7/2006 |
| CN | 2827733 | Y | 10/2006 |
| CN | 1853947 | A | 11/2006 |
| CN | 101264699 | A | 9/2008 |

* cited by examiner

*Primary Examiner* — Manish S Shah
*Assistant Examiner* — Jeremy Delozier
(74) *Attorney, Agent, or Firm* — Cantor Colburn LLP

(57) ABSTRACT

A main frame supports a printer head. A first movable frame supports a platen and a first paper feeding roller, and is pivotally connected to one end of the main frame via a first pivot shaft to permit itself to be opened or closed relative to the main frame. A second movable frame supports a second paper feeding roller, and is pivotally connected to the other end of the main frame via a second pivot shaft to permit itself to be opened or closed relative to the main frame. When the first movable frame and the second movable frame are closed relative to the main frame, the printer head is opposite to the platen to form a printing position; and the first paper feeding roller is tangent to the second paper feeding roller.

9 Claims, 4 Drawing Sheets

DOT-MATRIX PRINTER

The present application claims priority of a Chinese Patent No. 200810167483.9 filed with the Chinese Patent Office on Oct. 10, 2008, entitled "Dot-Matrix Printer", the disclosure of which is hereby incorporated by reference herein in its entirety.

FIELD OF THE INVENTION

The present invention relates to a printer, in particular to a dot-matrix printer.

BACKGROUND OF THE INVENTION

The dot-matrix printer is the earliest form of a printer. The dot-matrix printer has advantages of simple structure and low cost. What is more important is, the dot-matrix printer is characterized by printing in an impact manner. Such a characteristic is a second-to-none choice in various printing occasions such as department stores, supermarkets, etc, in which it is needed to provide duplications.

The operation principle of the dot-matrix printer is that, a printer head drives its printer pins to impact an ink ribbon to bring the ink of the ink ribbon onto a printing medium, so as to form images and characters on the printing medium. In order to facilitate replacing the printing medium, the dot-matrix printing generally uses an "easy-paper-loading" structure. However, the "easy-paper-loading" mechanism provided in the prior art has some apparent drawbacks.

FIG. 1 is a paper-rolling printer disclosed by Chinese Patent Document CN03148992. In said printer, a fixed frame 12 supports a printer head, a movable frame 13 supports a paper supporting member 55, the movable frame 13 is hinged to the fixed frame 12 via a pivot shaft, and the movable frame 13 rotates about the pivot shaft to be opened or closed relative to the fixed frame 12. When the movable frame 13 is closed relative to the fixed frame 12, the printer head is opposite to the paper supporting member 55 to form a printing position. Along the paper-conveying direction, a first path 15 and a second path 36 are provided at downstream of the printing position, wherein the first path 15 is used for guiding printed paper 7*a* to be outputted from a paper exit of the printer, and the second path 36 is used for guiding an ink ribbon 9 to be conveniently placed at the printing position. In addition, said printer also comprises a pair of rollers, wherein one roller 25 is mounted in the movable frame 13, and the other roller 26 is mounted between the first path 15 and the second path 36 for outputting the printed paper from the printer. In order to facilitate bringing the ink ribbon into the printing position, a first guiding surface 27*a* and a second guiding surface 41*a* are provided at two sides of the second path 36. The disadvantage of the above invention is that, the roller 26 is provided between the first path 15 and the second path 36, directly above the printer head. Such a configuration, on one hand, hinders the smooth entry of the ink ribbon into a printing position, resulting in difficulties in replacing the ink ribbon, and on the other hand, hides the printer head to bring trouble to the cleaning and maintenance of the printer head.

SUMMARY OF THE INVENTION

With respect to the above defects, the present invention aims at providing a dot-matrix printer, which facilitates the replacement of the ink ribbon and the cleaning and maintenance of the printer head.

The dot-matrix printer provided by the present invention comprises a main frame, a first movable frame, and a second movable frame, wherein the main frame supports a printer head; the first movable frame is used for supporting a platen and a first paper feeding roller, and is supported by the main frame and pivotally connected to one end of the main frame via a first pivot shaft to permit itself to be opened or closed relative to the main frame; the second movable frame is used for supporting a second paper feeding roller, and is supported by the main frame and pivotally connected to the other end of the main frame via a second pivot shaft to permit itself to be opened or closed relative to the main frame, and wherein when the first movable frame and the second movable frame are closed relative to the main frame, the printer head is opposite to the platen to form a printing position; and the first paper feeding roller is tangent to the second paper feeding roller.

Preferably, a paper feeding mechanism, formed by the tangential cooperation of the first paper feeding roller and the second paper feeding roller, is provided downstream of the printing position.

Preferably, at least one of the first paper feeding roller and the second paper feeding roller is provided in a floating manner to act as a floating rotation roller, and is supplied with a pressure by an elastic member in the direction toward a paper exit path.

Preferably, the floating rotation roller is mounted in such a way: an elongated slot perpendicular to the direction of the paper exit path is provided in a bracket for supporting the floating rotation roller, and the two shaft ends of the floating rotation roller are supported by the elongated slot and are movable in the elongated slot, and the elastic member is provided between the floating rotation roller and the bracket.

Preferably, the bracket supporting the floating rotation roller is formed integrally with the movable frame where it is located, or fixed, as an independent member, on the movable frame where it is located.

Preferably, the printer also comprises an automatic paper cutting device located along the paper conveying direction and downstream of the paper feeding mechanism.

Preferably, it further comprises a movable blade and a fixed blade, wherein the movable blade is mounted in one of the first movable frame and the second movable frame, and the fixed blade is mounted in the other one of the first movable frame and the second movable frame.

Preferably, its paper cartridge is provided at one side of the main frame corresponding to the first movable frame or at one side of the main frame corresponding to the second movable frame; and the printer head and the ink ribbon cassette support are provided at one side of the main frame corresponding to the other movable frame.

Preferably, the upper portion of the first movable frame and/or the second movable frame are in such a structure that it is partially open.

Preferably, the first pivot shaft and/or the second pivot shaft are in pivotal connection in a detachable manner.

Compared with the prior art, the dot-matrix printer provided by the present invention may have two movable frames. The first paper feeding roller and the second paper feeding roller are provided in these two movable frames, respectively. When needing to replace the paper and the ink ribbon and to clean a printer head, the above movable frames can rotate about the main frame to be opened so as to drive both the first paper feeding roller and the second paper feeding roller to move synchronizally, such that the upper side of the printer head is completely exposed, avoiding the inconvenience of replacing the ink ribbon and cleaning the printer head in the prior art.

DETAILED DESCRIPTION OF THE PREFERRED EMBODIMENTS

Figure 1:
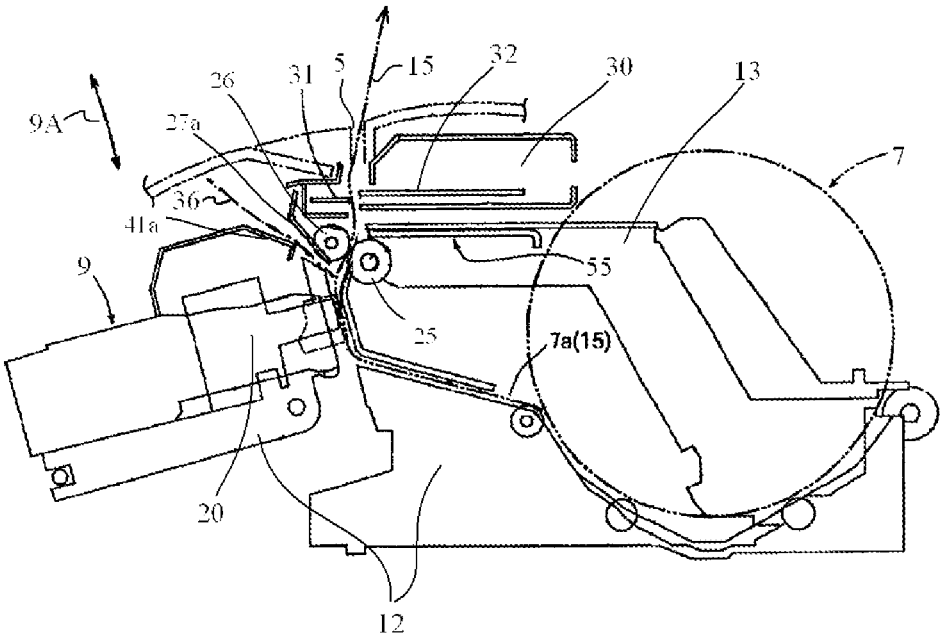
FIG. 1 is a structural view of a dot-matrix printer provided in the prior art.
Figure 2:
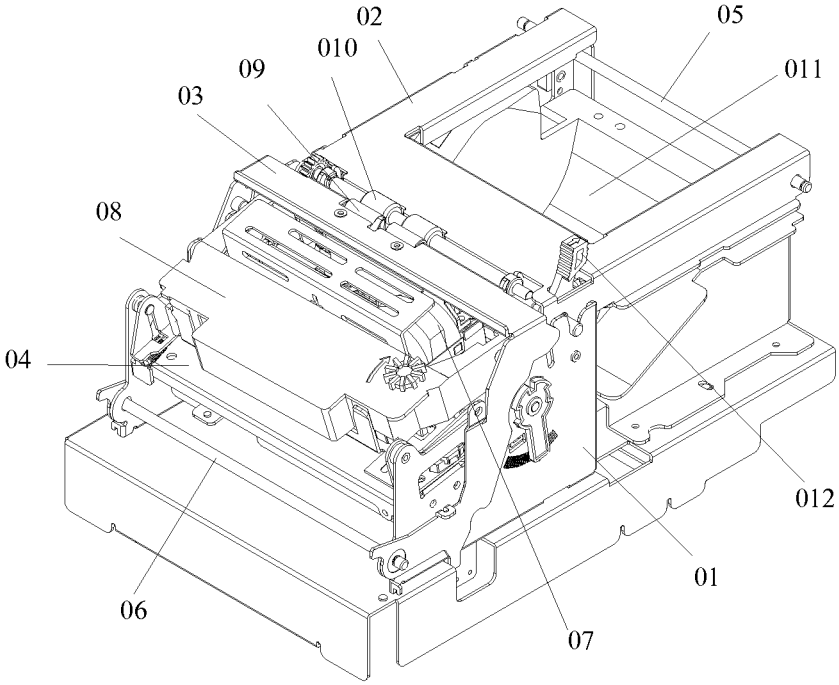
FIG. 2 is a structural view of a dot-matrix printer in an operational condition according to the first embodiment of the present invention.

FIG. 2 is a schematic view of a dot-matrix printer according to the first embodiment of the present invention. In said figure, the printer is in an operational state.

As shown in FIG. 2, the printer mainly comprises a main frame 01, a first movable frame 02, and a second movable frame 03. For the sake of convenience, a movable frame is used hereinafter as a general name for the first movable frame 02 and the second movable frame 03.

The main frame 01 supports a printer head 07.

The first movable frame 02 is supported by the main frame 01 wherein one end thereof is pivotally connected to one end of the main frame 01 in the length direction via a first pivot shaft 05 and the other end thereof is clamped into an intermediate part of the main frame 01 in a longitudinal direction via a detachable clamping structure. With the above structure, it is made opened or closed relative to the main frame 01. In the figure, the first movable frame 02 is in the structure in which its upper portion is opened. In fact, it is also possible that a complete upper plate completely covers the upper portion of the printer on this position.

The second movable frame 03 is supported by the main frame 01 and pivotally connected with the other end of the main frame 01 by a second pivot shaft 06, and the other end thereof is clamped into an intermediate part of the main frame 01 in a longitudinal direction via a detachable clamping structure. With the above structure, it is made opened or closed relative to the main frame 01. In this figure, the second movable frame 03 is in the structure in which its upper position is opened. In fact, it is possible that a complete upper plate completely covers the upper portion of the printer on this position.

With the above structure, the first movable frame 02 is allowed to rotate about the first pivot shaft 05 to be opened towards one end of the main frame 01, and the second movable frame 03 is allowed to rotate about the second pivot shaft 06 to be opened towards the other end of the main frame 01.

A paper cartridge 011 of the dot-matrix printer is provided on the main frame 01 and located below the first movable frame 02. It can be seen from FIG. 2 that, a downwardly dent arc shape is defined at the opening position on the main frame 01 corresponding to the upper portion of the first movable frame 02. Such a position is used for the paper cartridge 011 for mounting a printing medium. The printing medium of the dot-matrix printer is generally tube-shaped printing paper. Due to the open upper portion, it is convenient to place a tube-shaped medium with a larger diameter.

An ink cassette 08 of the dot-matrix printer is provided on the main frame 01 and located below the second movable frame 03. It can be seen from FIG. 2 that, the ink cassette 08 and the printer head 07 are mounted at the opening position on the main frame 01 corresponding to the upper portion of the second movable frame 03, wherein the ink cassette 08 is provided near the position where the main frame 01 is pivotally connected to the second frame 03, and the printer head 07 is provided at the position close to the first movable frame 02. Particularly, the ink cassette 08 is provided at said position via the ink ribbon support 04, and the ink cassette 08 can be conveniently detached from the ink ribbon support 04, such that the replacement of the ink cassette 08 is very convenient.

Figure 3:
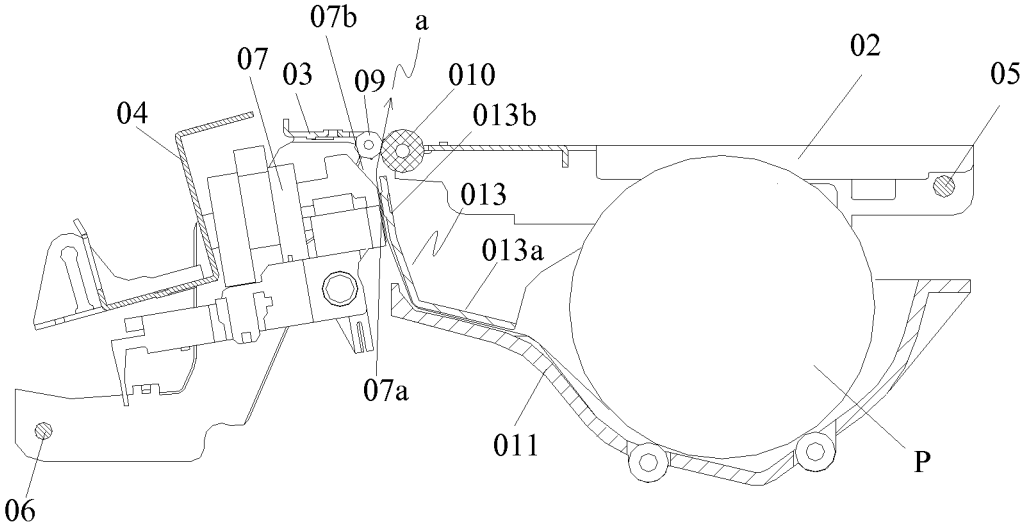
FIG. 3 is a sectional view of a dot-matrix printer in an operational condition according to the first embodiment of the present invention.

In the above the basic arrangement of the primary components of the dot-matrix printer is introduced. A paper feeding path of the dot-matrix printer is described hereinafter in combination with FIG. 3. FIG. 3 is a sectional view of the dot-matrix printer as shown in FIG. 2.

As shown in FIG. 3, an upper path plate 013 is provided at one end of the first movable frame 02 corresponding to the first pivot shaft 05, and the upper path plate 013 is an irregular arc-shaped plate which is opening towards the first pivot shaft 05. The upper path plate 013 comprises two parts, a paper pressing plate 013*a* and a platen 013*b*. The paper pressing plate 013*a* is a segment which, in operational position, is located at the lower portion and, against the main frame 01 and is close up to the bottom surface of the paper cartridge 011. In operation, the external surface thereof facing outside and the upper surface of the bottom plate of the paper cartridge 011 form a prearranged gap therebetween, constituting a paper entry path. The platen 013*b* is a segment which, in an operational position, abuts against the printer head 07. In operation, said position faces exactly a printing surface 07*a* of the printer head 07 to form the printing position. A first paper feeding roller 010 is mounted at the top of the platen 013*b* in said first frame 02, correspondingly to which, a second paper feeding roller 09 is mounted in the second movable frame 03. In the operational state, the above first paper feeding roller 010 is just in tangential cooperation with the second paper feeding roller 09, to form a paper feeding mechanism. The printing surface 07*a* and the platen form a printing path therebetween. The first paper feeding roller 010 and the second paper feeding roller 09 form a paper exit path therebetween. The paper entry path, the printing path, and the paper exit path together form a paper feeding path of printing paper P. The printing paper P is outputted by the paper cartridge 011, then passes sequentially through the paper entry path and the printing path, and finally is outputted from the paper exit path.

Figure 4:
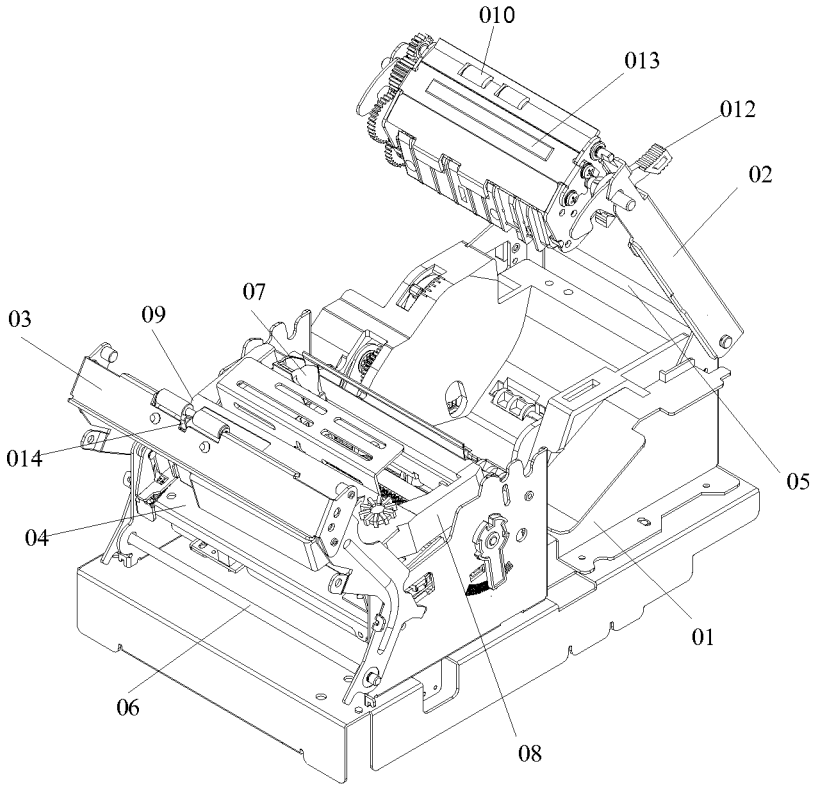
FIG. 4 is a structural view of a dot-matrix printer in an opened condition according to the first embodiment of the present invention.

FIG. 4 is a schematic view of the dot-matrix printer after the first movable frame 02 and the second movable frame 03 are opened. It can be seen from the figure that, both the first movable frame 02 and the second movable frame 03 can be completely opened to expose completely the top of the printer head 07, such that it is convenient to replace the ink cassette 08 and to clean the printer head 07.

Figure 5:
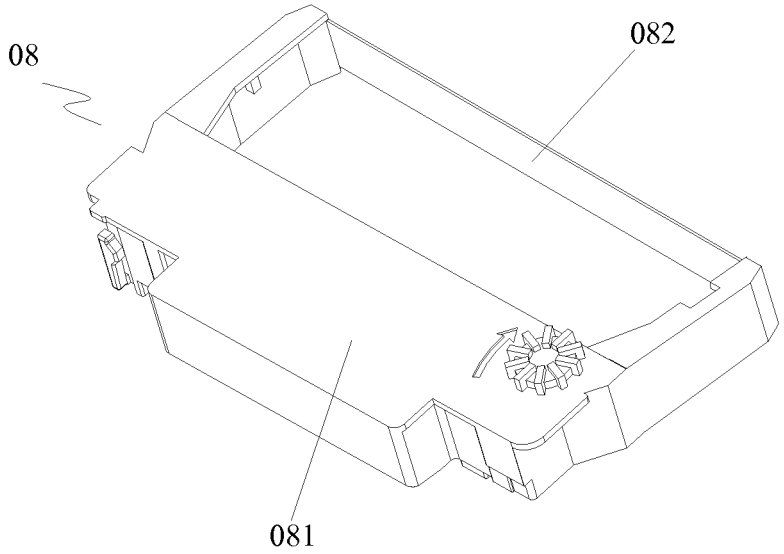
FIG. 5 is a structural view of an ink cassette of a dot-matrix printer according to the first embodiment of the present invention.

For easily understanding the above advantages of this embodiment, the structure and the mounting method of the ink cassette 08 are further described hereinafter. Referring to FIG. 5, said figure is a schematic view of the ink cassette 08.

As shown in FIG. 5, the ink cassette 08 comprises a case 081 and an ink ribbon 082. The ink ribbon 082 is drawn out from one end of the case and enters the other end of the case. The surface of the ink ribbon 082 is covered by ink. When printing, the case 081 is supported by the ink ribbon support 04. The ink ribbon 082 covers the surface of the printing end surface 07*a* of the printer head 07. The printing pin (not shown in the figure) of the printer head 07 perpendicular to the ink ribbon 082 impacts the ink ribbon 82 to bring the ink thereof onto the printing paper P to form images and characters. The surface of the printing paper P facing away the printer head 07 is padded under the platen 013*b* of the upper path plate 013 of the first movable frame 02.

As mentioned in the above, said ink cassette 08 is mounted in a detachable manner on the main frame 01 via the ink ribbon support 04. The ink cassette 08 needs to be replaced frequently in use. The process of mounting the ink cassette 08 in this embodiment is as follows: the second movable frame 03 is opened to completely expose the ink ribbon support 04; since the second paper feeding roller 09 rotates with the second movable frame 03 and there is no obstacle above the printer head 07, the ink ribbon 082 enters the printing position under the guidance of the guiding surface 07*b* of the printer head 07; and then the second movable frame 03 is closed to accomplish the mounting of the ink cassette 08. The guiding surface 07*b* of the printer head 07 is shown in FIG. 3.

The process of mounting the printing paper P is as follows: the first movable frame 02 is opened to completely expose the paper cartridge 011; the printing paper P is put into the paper cartridge 011; next, the front end of the printing paper is drawn out and then the first movable frame 02 and the second movable frame 03 are closed; at this time, the printing paper P is held on the paper entry path and the printing position, and the front end thereof is clamped tightly by the first paper feeding roller 010 and the second paper feeding roller 09. In this way, the rotation of the first paper feeding roller 010 and the second paper feeding roller 09 can drive the printing paper P to move in a paper conveying direction indicated by an arrow a as shown in FIG. 3.

Figure 6:
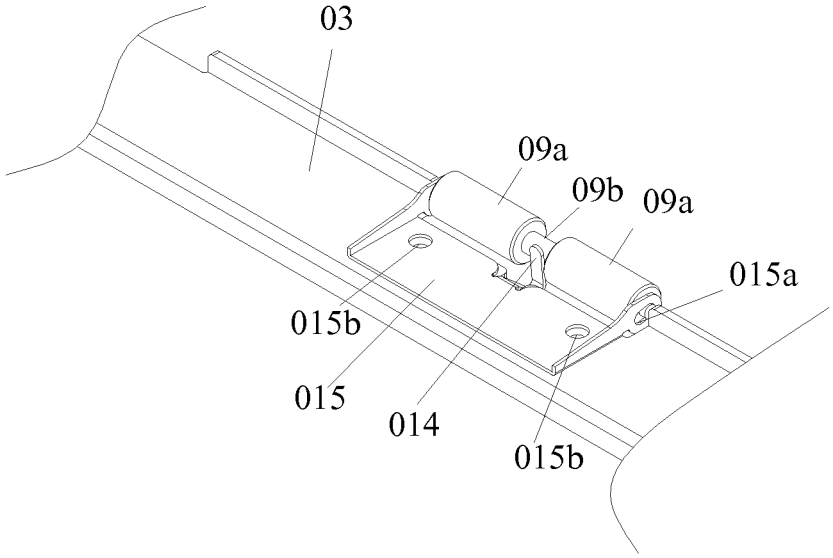
FIG. 6 is a structural view for mounting a second paper feeding roller of a dot-matrix printer according to the first embodiment of the present invention.

FIG. 6 is a structural schematic view for mounting the second paper feeding roller 09 of the present invention. As shown in the Figure, the second paper feeding roller 09 is fixed on the second movable frame 03 via a bracket 015. The bracket 015 comprises a fixing surface 015-1 attached against the second movable frame 03 and is fixed to the second movable frame 03 through a through hole 015*b* of the fixing surface 015-1. The left and right ends of said bracket 015 have protruding branch arms 015-2. An elongate slot 015*a* is provided on the branch arms 015-2. The second paper feeding roller 09 comprises a roller body 09*a* and a core shaft 09*b*. The shaft end of the core shaft 09*b* is inserted into the elongated slot 015*a* and is supported by the elongated slot 015*a*, and is movable in the elongated slot 015*a*. The roller body 09*a* comprises two segments of cylindrical bodies sleeved onto the surface of the core shaft 09*b* and having relatively great frictional force. An elastic member 014 is provided in the bracket 015. Said elastic member 014 provides to the second paper feeding roller 09 an elastic force toward the front end. In this way, in an operational state, a certain pressing force is present between the first paper feeding roller 010 and the second paper feeding roller 09, such that the two can clamp the paper tightly therebetween to ensure the synchronous movement of the printing paper with the first paper feeding roller 010 and the second paper feeding roller 09.

The mounting manner of the second paper feeding roller 09 can be also applied to the first paper feeding roller 010, as long as one of the two uses the above movable mounting manner and the elastic member is used for providing to the one a pressing force toward the paper exit path. Of course, it is possible that the two use simultaneously the above mounting manner.

When printing, the printing paper P moves in a paper conveying direction indicated by the arrow a. The printing paper P passes through the paper entry path and enters the printing position. The printer pin of the printer head 07 impacts the ink ribbon 082 to bring the ink thereof onto the printing paper P to form images and characters. The printed printing paper P is outputted from the printer under the driving of the first paper feeding roller 10 and the second paper feeding roller 9.

What needs to be explained is that, the bracket 015 can be an independent member which is mounted on the second movable frame 03, as shown in the embodiment of FIG. 6. In addition, the bracket 015 can be formed integrally with the second movable frame 03, viz. the branch arms 015-2 supporting the second paper feeding roller 09 are directly provided on the second movable frame 03.

Figure 7:
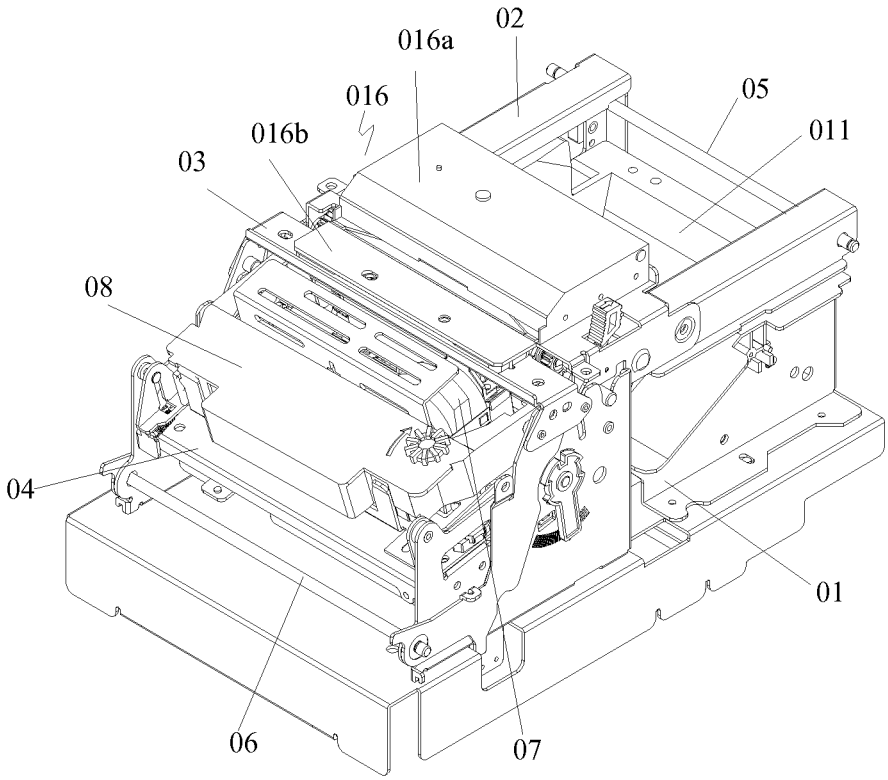
FIG. 7 is a structural view of a dot-matrix printer according to the second embodiment of the present invention.

FIG. 7 is a schematic diagram of the printer according to the second embodiment of the present invention. The difference between the present embodiment and the first embodiment of the present invention is that the printer further comprises an automatic paper cutting device 016. Along the paper conveying direction, the automatic paper cutting device 016 is located downstream of the paper conveying mechanism. The automatic paper cutting device 016 comprises a movable blade 016*a* and a fixed blade 016*b*. As shown in this figure, the movable blade 16*a* is provided above the first paper feeding roller 010 of the first movable frame 02 and the fixed blade 016*b* is provided above the second paper feeding roller 09 of the second movable frame 03. When the printer is in an operational state, the movable blade 016*a* and the fixed blade 016*b* cooperate with each other. When the first movable frame 2 and the second movable frame 3 are opened relative to the main frame 01, the movable blade 016*a* rotates with the first movable frame 02. The fixed blade 016*b* can rotate with the second movable frame 03. Said printer may cut automatically the printed paper.

In the above second embodiment, the mounting positions of the movable blade 016*a* and the fixed blade 016*b* can be exchanged, viz. the movable blade 16*a* is provided above the second paper feeding roller 09 of the second movable frame 03, and the fixed blade 016*b* is provided above the first paper feeding roller 010 of the first movable frame 02.

Further improvement can be made on the above two embodiments. For example, the first pivot shaft 05 and the second pivot shaft 06 is in the form of a detachable pivot shaft to allow the first movable frame 02 and the second movable frame 03 to be completely detached from the main frame 01. With such a structure, the printer can have more flexibility.

The description above is given merely for preferable embodiments of the present invention. It shall be pointed out that, for the person skilled in the art, any improvements and modifications can be made without departing from the principles of the present invention. The improvements and modifications can be deemed as being covered by the scope of protection of the present invention.

What is claimed is:

1. A dot-matrix printer, comprising a main frame, a first movable frame, and a second movable frame, wherein the main frame supports a printer head;

the first movable frame is used for supporting a platen and a first paper feeding roller, and is supported by the main frame and pivotally connected to one end of the main frame via a first pivot shaft so as to permit itself to be opened or closed relative to the main frame, the first movable frame being configured to rotate around the first pivot shaft to be opened towards the one end of the main frame;

the second movable frame is used for supporting a second paper feeding roller, and is supported by the main frame and pivotally connected to the other end of the main frame via a second pivot shaft so as to permit itself to be opened or closed relative to the main frame; and wherein when the first movable frame and the second movable frame are closed relative to the main frame, the printer head is opposite to the platen to form a printing position, the second movable frame being configured to rotate around the second pivot shaft to be opened towards the other end of the main frame;

the first paper feeding roller is tangent to the second paper feeding roller; and a paper feeding mechanism is formed by the tangential cooperation of the first paper feeding roller and the second paper feeding roller and is provided downstream of the printing position.

2. The dot-matrix printer according to claim 1, wherein at least one of the first paper feeding roller and the second paper feeding roller is provided in a floating manner to act as a floating rotation roller, and is supplied with a pressure toward a paper exit path by an elastic member.

3. The dot-matrix printer according to claim 2, wherein the floating rotation roller is mounted in such a way: an elongated slot perpendicular to the direction of the paper exit path is provided on a bracket for supporting the floating rotation roller, and two shaft ends of the floating rotation roller are supported by the elongated slot and movable in the elongated slot, and the elastic member is provided between the floating rotation roller and the bracket.

4. The dot-matrix printer according to claim 3, wherein the bracket for supporting the floating rotation roller is formed integrally with the first movable frame and/or the second movable frame where it is located, or fixed, as an independent member, on the movable frame where it is located.

5. The dot-matrix printer according to claim 1, wherein the printer further comprises an automatic paper cutting device located along the paper conveying direction and downstream of the paper feeding mechanism.

6. The dot-matrix printer according to claim 5, where the automatic paper cutting device further comprises a movable blade and a fixed blade, wherein the movable blade is mounted in one of the first movable frame and the second movable frame, and the fixed blade is mounted in the other one of the first movable frame and the second movable frame.

7. The dot-matrix printer according to claim 1, wherein a paper cartridge is provided at one side of the main frame corresponding to the first movable frame or at one side of the main frame corresponding to the second movable frame; and the printer head and an ink ribbon cassette support are provided at one side of the main frame corresponding to the other movable frame.

8. The dot-matrix printer according to claim 1, wherein an upper portion of the first movable frame and/or the second movable frame is in an structure in which the first movable frame and/or the second movable frame is partially open.

9. The dot-matrix printer according to claim 1, wherein the first pivot shaft and/or the second pivot shaft are in pivotal connection in a detachable manner.

* * * * *